United States Patent [19]

Jones et al.

[11] Patent Number: 4,580,638

[45] Date of Patent: Apr. 8, 1986

[54] FIRE SUPPRESSION AND CONTROL SYSTEM

[75] Inventors: Wendell M. Jones, Chattanooga, Tenn.; James L. Sattler, Ring Gold, Ga.; Richard Paul, Chattanooga; Neil S. Miller, Lookout Mountain, both of Tenn.

[73] Assignee: Mon/Arc, Inc., Chattanooga, Tenn.

[21] Appl. No.: 573,793

[22] Filed: Jan. 25, 1984

[51] Int. Cl.[4] ..... A62C 35/02

[52] U.S. Cl. ..... 169/49; 169/59; 169/60; 169/65; 169/DIG. 3

[58] Field of Search ..... 169/5, 16, 42, 48, 49, 169/57, 59, 60, 61, 65, DIG. 3

[56] References Cited

U.S. PATENT DOCUMENTS

| | | | |
|---|---|---|---|
| 816,352 | 3/1906 | Murphy | 169/59 |
| 886,968 | 5/1908 | Fuller . | |
| 3,209,837 | 10/1965 | Freedman | 169/42 |
| 3,283,827 | 11/1966 | Diehl | 169/65 |
| 3,407,879 | 10/1968 | O'Rear . | |
| 3,448,808 | 6/1969 | Scofield et al. | 169/59 |
| 3,521,692 | 7/1970 | Johnson et al. . | |
| 3,687,185 | 8/1972 | Singer . | |
| 3,766,958 | 10/1973 | Mitchell . | |
| 3,773,111 | 11/1973 | Dunn . | |
| 4,077,474 | 3/1978 | Hattori | 169/48 |
| 4,256,181 | 3/1981 | Searcy | 169/65 |

FOREIGN PATENT DOCUMENTS

| | | | |
|---|---|---|---|
| 2253934 | 5/1973 | Fed. Rep. of Germany | 169/65 |
| 2108839 | 5/1983 | United Kingdom | 169/48 |

*Primary Examiner*—Andres Kashnikow
*Assistant Examiner*—Michael J. Forman
*Attorney, Agent, or Firm*—Varnum, Riddering, Schmidt & Howlett

[57] ABSTRACT

A fire suppression and control system for a commercial cooking unit having a conventional chemical fire retardant discharge system has a flexible fire curtain supported by a hood and adapted to enclose the cooking unit from the room between the hood and the floor. A housing for storing the curtain in folded condition is positioned on the hood and includes a release mechanism for releasing the curtain from the housing when a fire occurs. A heat-responsive control for discharge of the fire-resistant chemical is coupled to the release mechanism for the curtain to release the curtain at the time the fire-retardant chemical is delivered to the cooking unit. The fire-retardant chemical is preferably a Halon 1211 gas. The release mechanism includes an electromagnetic coupling which is connected through an electrical circuit to a switch at a mechanical actuator for the valve in the chemical fire-retardant delivery system.

12 Claims, 5 Drawing Figures

FIRE SUPPRESSION AND CONTROL SYSTEM

TECHNICAL FIELD

This invention relates to a fire suppression and control system for commercial cooking units such as grills and deep-frying units.

BACKGROUND ART

In commercial restaurants, cooking grills and deep-fryer units have a hood for exhausting fumes. Fire suppression systems have conventionally been built into these hoods. These fire suppression systems include a nozzle in the hood, a source of a fire-retardant powder with a $C0_2$ propellant spaced from the cooking unit and piping and a valve connecting the source of fire-retardant chemical with the nozzle. A fusible link or other heat-sensitive mechanism is provided in the hood to open the valve when a fire occurs. The powder is thus dispersed through the nozzle. The chemical may put the fire out but the powder is spread over a very large area and takes considerable time to clean up. The restaurant may be closed for several days during the clean-up procedure. Further, dense black smoke usually spreads throughout the restaurant, causing alarm, and also causing smoke damage. An example of a fire-retardant system of this nature is disclosed in the U.S. Pat. No. 3,407,879 to O'Rear (issued Oct. 29, 1968). An example of another fire protection system built into a hood is disclosed in the U.S. Pat. No. 3,773,111 to Dunn (issued Nov. 20, 1973).

A fire-extinguishing system for a home range is disclosed in the Freedman U.S. Pat. No. 3,209,837 (issued Oct. 5, 1965). In Freedman, a fire-extinguishing powder is rolled up in a sheet material within a hood above the range. The sheet material is maintained in a roll by a fusible link. Upon melting of the fusible link, the sheet unrolls, thereby depositing the fire-extinguishing powder onto the range.

Fire curtains adapted to drop between a ceiling and a floor are disclosed by Singer in U.S. Pat. No. 3,687,185 (issued Aug. 29, 1972) and by Hattori in U.S. Pat. No. 4,077,474 (issued Mar. 7, 1978). In Singer, a fire curtain drops from the ceiling to the floor upon actuation of an automatically activated fire-extinguisher system which utilizes gas pressure to disengage a latch for the curtain. The release system relies on a drop in the gas pressure of the system. In Hattori, a mixture of water and a bubbling agent in the form of fine bubbles flows down the curtain to keep the curtain cool. The curtain is discharged by release of a latch through an automatically operated hydraulic cylinder.

SUMMARY OF THE INVENTION

According to the invention, there is provided a fire suppression and control system which can be added onto an existing solid-particle system with a minimum of changes or installed into a conventional hood. The invention automatically contains the fire while discharging a fire-retardant chemical which will be taken away by the conventional hood structure as soon as the fire is put out. A high concentration of the fire-retardant chemical is maintained at the source of the fire and smoke or other toxic chemicals are contained and exhausted through the conventional duct work.

According to the invention, a flexible fire curtain is supported by a hood and adapted to enclose a cooking unit from the room surrounding the cooking unit between the hood and the floor. A housing is provided for storing the curtain in folded condition on the hood, the housing including a release means for releasing the curtain from the housing. A coupling means is provided between a heat-responsive control means for release of fire-retardant chemical to the release means to release the curtain from folded condition in the housing as the fire-retardant chemical is delivered to the cooking unit through conventional nozzles. Thus, the curtain drops to surround the cooking unit as fire-retardant chemical is delivered to a fire on the cooking unit.

The release means is preferably an electromagnetic coupling which is connected to the heat-responsive control means through an electrical circuit. Desirably, an elongated plate is secured to the bottom end of the fire curtain and forms a bottom closure for the housing. An electromagnetic member is mounted to the elongated plate and registers with a ferromagnetic member on the hood when the elongated plate is positioned beneath the housing. A plurality of the electromagnetic elements and ferromagnetic elements are spaced along the hood and are actuated in unison to drop the curtain. The release means further includes a switch member with an actuator positioned at the valve in the delivery system for the fire- retardant chemical. The heat-responsive control means includes a mechanical element which is adapted to open a valve and at the same time to move the switch actuator to open the electromagnetic circuit. The electromagnetic circuit is connected between the switch and each of the electro-magnetic elements on the hood.

The preferable fire-retardant chemical used in the invention is a Halon 1211 gas which is a halogenated hydrocarbon gas, the chemical formula of which is $CBrClF_2$ and which is known as Bromochlorodifluoromethane.

BRIEF DESCRIPTION OF THE DRAWINGS

The invention will now be described with reference to the accompanying drawings in which.

DESCRIPTION OF THE PREFERRED EMBODIMENTS

Figure 1:
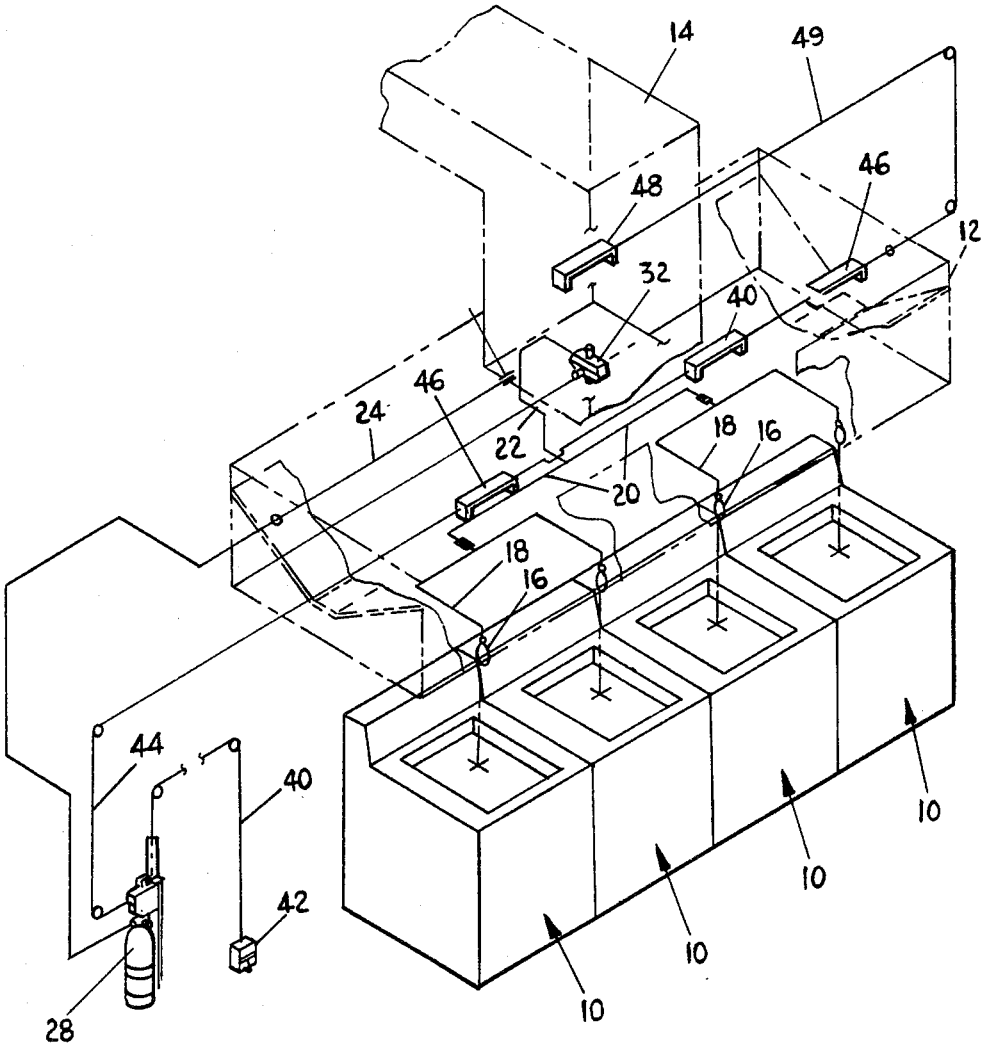
FIG. 1 is a perspective view in schematic form of a commercial grill, hood and fire-retardant chemical supply system.
Figure 2:
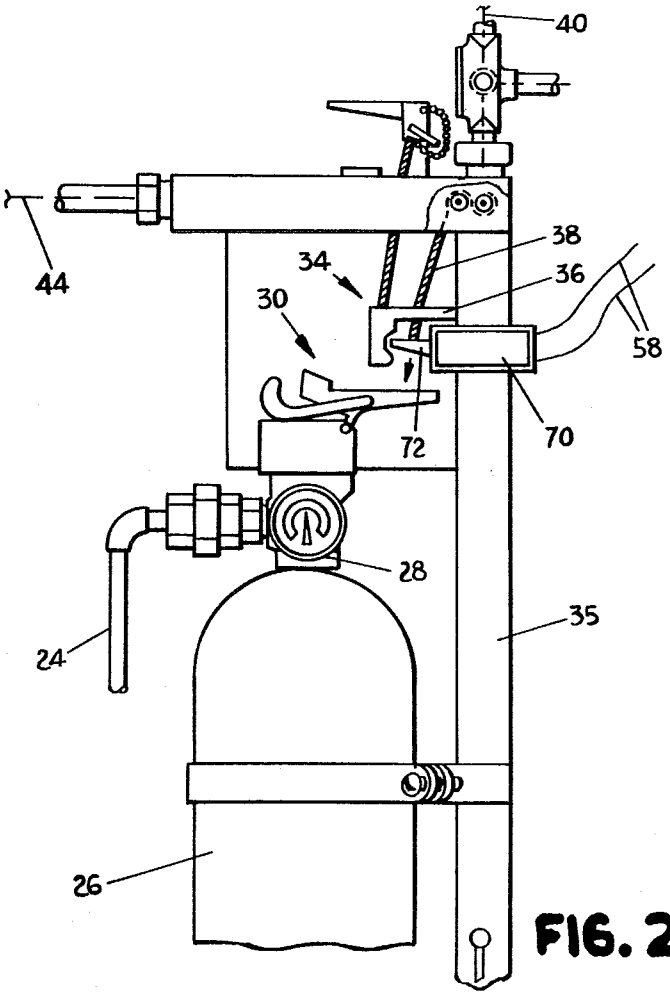
FIG. 2 is an enlarged elevational view of the mechanical valve arrangement for the chemical supply system and also illustrating a portion of the invention.

Referring now to the drawings, and to FIGS. 1 and 2 in particular, there is shown a number of commercial cooking units 10 such as grills or deep-fryers. A conventional hood 12 with a conventional exhaust duct 14 is shown in phantom lines mounted above the cooking units 10. Nozzles 16 are mounted above each of the cooking units 10 and are connected to a pressure cylinder 26 through conduits 18, 20, 22 and 24 in conventional fashion. A valve 28 (FIG. 2) is mounted on top of the pressure cylinder 26 to control the flow of pressurized fire suppressant material, preferably Halon III gas, from the pressurized cylinder 26 to the nozzles 16. A mechanical valve release arm 30 controls the operation of the valve 28. A hood-and-duct nozzle 32 is mounted in the duct 14 and is connected to the pressurized cylinder 26 through the conduit 24 and valve 28 for dispensing fire-retardant chemical into the exhaust duct 14. A conventional exhaust blower (not shown) is provided in the duct 14 to draw the fumes and air through the hood 12 and through the exhaust duct 14.

A mechanical actuator 34 is positioned on a post 35 above the mechanical valve-release arm 30 and has a lever arm 36 for actuating the mechanical valve-release arm 30. A cable 38 operates the lever arm 36 and is connected at one end to a remote pull box 42 through a cable 40 and at the other end to fusible links 46 through a cable 44. The fusible links 46 are positioned above the commercial cooking units 10 to sense the heat generated therein. Another fusible link 48 is provided in the hood 12 and is connected to the cable 44 through cable 49 and the fusible link 46.

In the event of fire in any one of the cooking units 10, one of the fusible links 46 will be melted, thereby releasing cable 44 to drop arm 36, thereby actuating the mechanical valve-release arm 30 to open the valve 28. Fire-retardant chemical will thereby be dispensed through conduit 24, conduit 22, conduits 20, 18 and to the nozzle 16. In the event of a fire in the hood 12 or on the cooking unit 10, the fusible link 48 will be melted, thereby releasing cable 49 and cable 44 to release fire-retardant chemical from the cylinder 26 through the valve 28 in the same manner as has been described above.

The foregoing has been a description of a conventional fire-retandant system with the exception of the use of Halon gas. Ordinarily, a powder fire-retardant material is dispensed through the nozzle, thereby distributing particulate matter all through the restaurant kitchen. The particulate matter requires extensive clean-up and frequently requires closing of the restaurant for several days to provide the clean-up. The clean-up problem results principally from the fire-retardant chemical rather than any fire itself.

Figure 3:
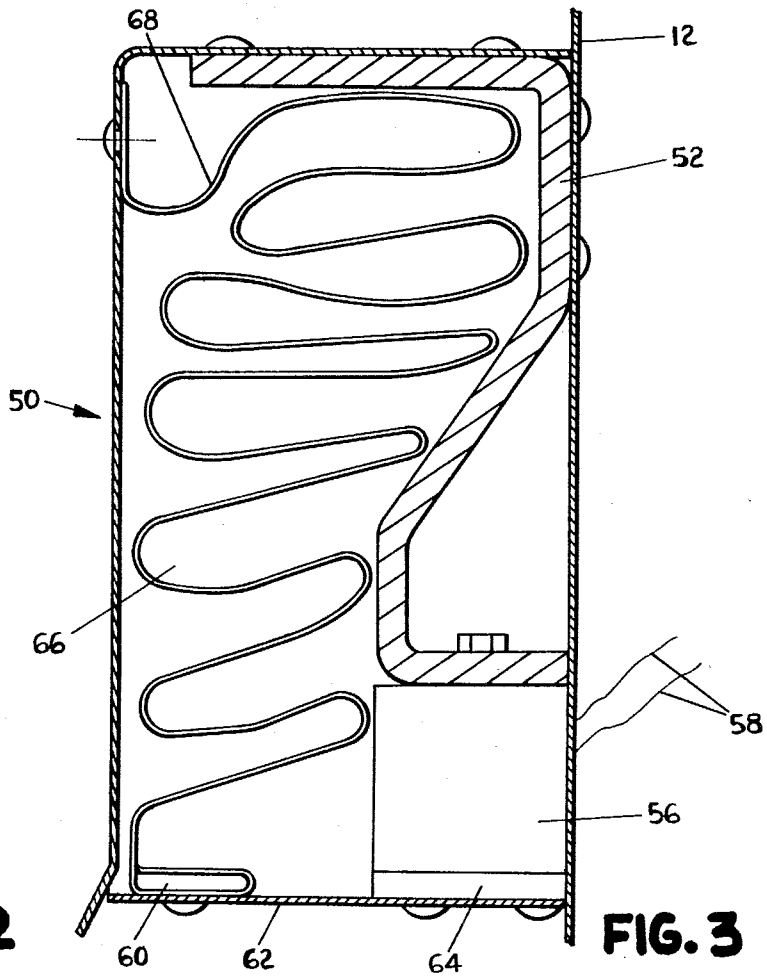
FIG. 3 is a side elevational view, in section, of a portion of the hood illustrating a drop curtain according to the invention.
Figure 4:
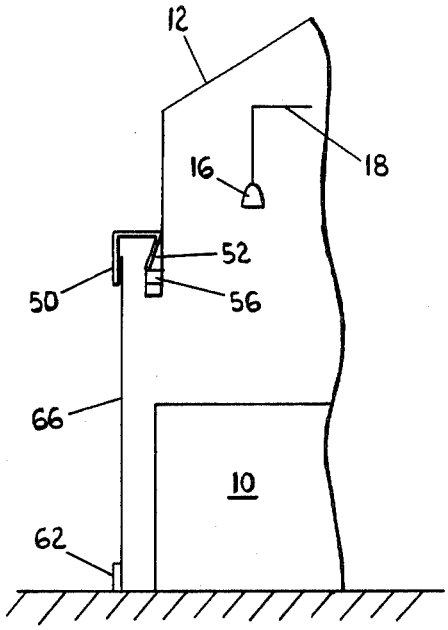
FIG. 4 is a side elevational view of the fire suppression system, illustrating the curtain in the drop position.

According to the invention, Halon 1211 gas is used as the fire-suppressant material in the cylinder and a drop curtain is provided around the hood 12 to encapsulate the entire area encompassing the commercial grill or deep fryers. Reference is made to FIGS. 3 and 4 for a description of the manner in which the fire curtain is supported by the hood.

An L-shaped container 50 is mounted to the outside of the hood 12 through L-shaped brackets 52. Electromagnets 56 are secured to inwardly bent bottom portions 54 of the L-shaped brackets 52. Electrical wiring 58 is connected to the electromagnet 56 to energize the same. Although only one bracket 52 and electromagnet 56 are shown, it should be understood that a number of such brackets 52 and electromagnets are spaced along the hood 12.

A metal bottom flap 62 is mounted on the bottom of the container 50 through ferromagnetic members 64 which are magnetically coupled to the electromagnets 56. The bottom flap 60 is then securely held in place beneath the L-shaped container 50. A fire curtain 66 is provided accordian style within the L-shaped container 50 and is secured at its upper end 68 to the top of the L-shaped container 50. The bottom of the curtain 66 is secured to the bottom flap 60 through conventional rivets. The fire curtain 66 can be any non-conbustable woven or nonwoven flexible curtain material, such as Nomex III manufactured by DuPont.

As seen in FIG. 2, a microswitch 70 is mounted on post 35 and has an arm 72 in engagement with the lever arm 36. When the lever arm 36 is dropped, as released by the cable 38 or 44, the actuator arm 72 will trip the microswitch 70 and open the circuit including the electromagnets 56. As illustrated in FIG. 2, the microswitch 70 is connected to the electrical wires 58, which in turn are connected to the electromagnets 56.

As seen in FIG. 4, the fire curtain 66 extends all the way from the housing 50 to the floor when it is dropped, thereby completely enclosing the cooking unit from the room in which it is placed. The fire curtain can extend around all four sides of the cooking unit 10 in the event that the cooking unit is positioned away from a wall. Alternatively, the curtain can extend around three sides of the cooking unit 10 in the event that the unit is placed against a wall. The curtain thus follows the hood and forms with any wall surfaces contiguous thereto an enclosure for the cooking unit.

Figure 5:
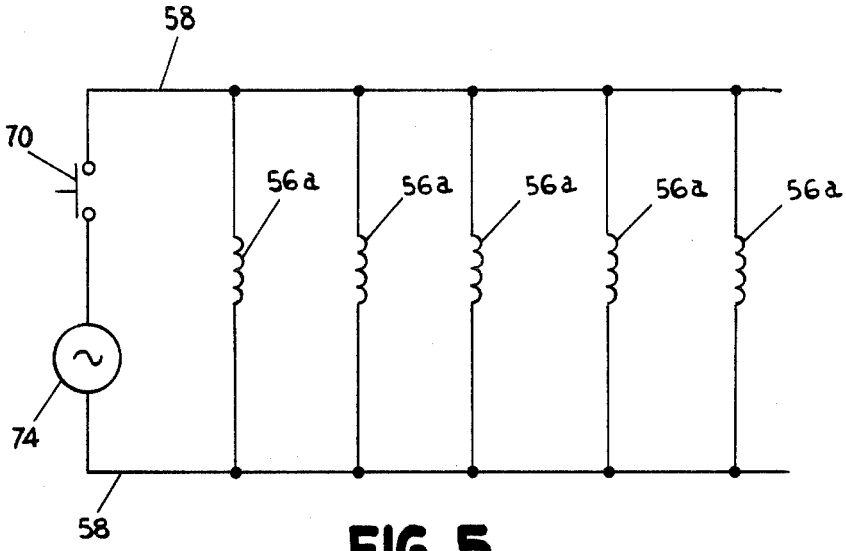
FIG. 5 is a schematic electrical diagram of an electrical circuit used in the invention.

Referring now to FIG. 5, a source of electrical power 74 is connected in parallel to a number of electromagnetic coils **56*a* through a switch 70 and electrical leads 58. The switch 70 is normally closed. Upon opening the switch 70, the power to the electromagnetic coils 56*a*** is cut off.

In operation, as the arm 36 is tripped, the electromagnets 56 will release the bottom flap 60 to drop the curtain 66 to completely surround the cooking unit 10. At the same time, Halon gas will be dispensed through valve 28, through conduits 24, 22, 20, 18 and to the nozzle 16 or to the nozzle 32. The curtain 66, which is of a fire-retardant material, simultaneously drops to surround the commercial cooking unit 10. Thus, the fire-retardant material is contained within the curtains and the fire is also suffocated due to the lack of oxygen. The need to clean up other portions of the restaurant is thus obviated by the curtain-drop system. Further, the use of the Halon gas also avoids messy clean-up problems.

Reasonable variation and modification are possible within the scope of the foregoing disclosure and drawings without departing from the spirit of the invention.

The embodiments of the invention in which an exclusive property or privilege is claimed are defined as follows:

1. In a fire suppression and control system for a cooking unit having an exhaust hood above the cooking unit;

a nozzle on the hood above the cooking unit for distributing a fire-retardant chemical onto the cooking unit in the event of a fire;

a source of fire-retardant chemicals spaced from the hood;

conduit means between the fire-retardant chemical source and the nozzle for delivering a fire-retardant chemical to the nozzle;

valve means in the conduit means for controlling the flow of the fire-retardant chemical between the source and the nozzle; and heat-responsive control means in the hood for detecting the presence of a fire in the cooking unit and for actuating the valve responsive thereto to deliver the fire-retardant chemical to the cooking unit, the improvement which comprises:

a flexible fire curtain supported by the hood and adapted to enclose the cooking unit from the room surrounding the cooking unit between the hood and the floor;

housing means for storing the curtain in folded condition on the hood, including a release means for releasing the stored curtain from the housing means; and means coupling the heat-responsive control means to the release means to release the curtain from folded condition in the housing means as the fire-retardant chemical is delivered to the cooking unit through the nozzle so that the fire-retardant curtain drops to surround the cooking unit as the fire-retardant chemical is delivered to a fire on the cooking unit.

2. A fire suppression and control system according to claim 1 wherein the release means comprises an electromagnetic coupling which is connected to the heat-responsive control means through an electrical circuit.

3. A fire suppression and control system according to claim 2 wherein the release means further comprises an elongated plate which is secured to the bottom end of the fire curtain and which forms a bottom closure on the housing means.

4. A fire suppression and control system according to claim 3 wherein the release means further includes a ferromagnetic member on the elongated plate.

5. A fire suppression and control system according to claim 4 wherein the release means further comprises an electromagnetic element in registry with the ferromagnetic member.

6. A fire suppression and control system according to claim 5 wherein said release means comprises a plurality of said electromagnetic elements and ferromagnetic members spaced along said hood.

7. A fire suppression and control system according to claim 6 wherein said release means includes a switch member with an actuator positioned at said valve means, said heat-responsive control means includes a mechanical element which is adapted to open said valve, said switch actuator being positioned for movement by said mechanical element as said mechanical element opens said valve, and said electrical circuit is connected between said switch member and each of said electromagnetic elements.

8. A fire suppression and control system according to claim 7 wherein said fire-retardant chemical is a gas.

9. A fire suppression and control system according to claim 8 wherein said gas is a Halon gas.

10. A fire suppression and control system according to claim 5 wherein the release means includes a switch member with an actuator positioned at the valve means, said heat-responsive control means includes a mechanical element which is adapted to open the valve, said switch actuator being positioned for actuation by said mechanical element as the mechanical element opens the valve.

11. A fire suppression and control system according to claim 1 wherein said fire-retardant chemical is a gas.

12. A fire suppression and control system according to claim 11 wherein said gas is a Halon gas.

* * * * *